US008369186B2

(12) United States Patent
Brykowski et al.

(10) Patent No.: US 8,369,186 B2
(45) Date of Patent: Feb. 5, 2013

(54) SYSTEM AND METHOD OF INCREASING BATTERY LIFE OF A TIMEKEEPING DEVICE

(75) Inventors: Derek J. Brykowski, Crystal Lake, IL (US); Terrence J. O'Neill, Lake Geneva, WI (US); Vince Guarna, Mundelein, IL (US); John Hill, Lake Villa, IL (US)

(73) Assignee: Primex Wireless, Inc., Lake Geneva, WI (US)

( * ) Notice: Subject to any disclaimer, the term of this patent is extended or adjusted under 35 U.S.C. 154(b) by 546 days.

(21) Appl. No.: 12/685,451

(22) Filed: Jan. 11, 2010

(65) Prior Publication Data

US 2010/0177600 A1 Jul. 15, 2010

Related U.S. Application Data

(60) Provisional application No. 61/143,567, filed on Jan. 9, 2009.

(51) Int. Cl.
*G04C 11/00* (2006.01)

(52) U.S. Cl. ..... 368/46; 368/47

(58) Field of Classification Search ..... 368/46–47
See application file for complete search history.

(56) References Cited

U.S. PATENT DOCUMENTS

| | | | | |
|---|---|---|---|---|
| 4,448,543 | A | 5/1984 | Vail | |
| 4,899,117 | A | 2/1990 | Vig | |
| 5,274,545 | A | 12/1993 | Allan et al. | |
| 7,423,935 | B2 * | 9/2008 | Oguchi | 368/47 |
| 7,428,190 | B2 * | 9/2008 | Sano | 368/47 |
| 7,681,064 | B2 * | 3/2010 | Engler et al. | 713/503 |
| 7,961,554 | B2 * | 6/2011 | Seal et al. | 368/10 |
| 8,135,978 | B2 * | 3/2012 | Engler et al. | 713/503 |
| 2002/0018402 | A1 * | 2/2002 | Egle et al. | 368/46 |
| 2004/0165480 | A1 * | 8/2004 | Shemesh et al. | 368/46 |
| 2005/0002279 | A1 * | 1/2005 | Kondo | 368/104 |
| 2007/0058491 | A1 * | 3/2007 | Dahlen et al. | 368/46 |

* cited by examiner

*Primary Examiner* — Sean Kayes
(74) *Attorney, Agent, or Firm* — Michael Best & Friedrich LLP

(57) ABSTRACT

Methods and systems of extending battery life of remote battery-operated timekeeping devices by minimizing the number of required synchronizations per unit of time needed to maintain a predetermined accuracy of the devices. The number of synchronizations are minimized by first calculating a time error rate between the remote timekeeping device and a master device over a sample period. Then, a synchronization is delayed and the remote timekeeping device is compensated based on the time error rate. The compensation delays the need for a synchronization yet maintains the predetermined accuracy of the remote timekeeping device. In some embodiments, the remote timekeeping device is compensated and multiple synchronizations are delayed before a new synchronization is necessary to maintain the predetermined accuracy.

24 Claims, 7 Drawing Sheets

SYSTEM AND METHOD OF INCREASING BATTERY LIFE OF A TIMEKEEPING DEVICE

CROSS-REFERENCE TO RELATED APPLICATION

This application claims priority to U.S. Provisional Patent Application No. 61/143,567, filed on Jan. 9, 2009, the entire contents of which are incorporated herein by reference.

BACKGROUND

This invention relates to wireless synchronous time systems and, more particularly, to a system and method of increasing battery life of a remote battery-operated timekeeping device.

No matter how accurately two independent timekeeping devices (e.g., clocks) are initially calibrated and synchronized, the devices will over time deviate from each other. In order for clocks to maintain accuracy within specified limits, the clocks should be periodically synchronized to an accurate reference time. The maximum period between these synchronizations is dependent on the required accuracy and rate of timekeeping variation allowed for an individual clock. In the case of remote battery-operated wireless timekeeping devices, such synchronizations consume extra current from a battery and, thereby, shorten battery life. The amount of battery life decrease per synchronization varies depending on the particulars of the timekeeping device and its synchronization system. In some devices and systems, each synchronization may shorten the battery life by 5 hours to 50 hours. Therefore, to maximize battery life in a wireless timekeeping device, the number of synchronizations should be kept to a minimum.

It is typically acceptable for the accuracy of a timekeeping device to vary for different uses, functions, or circumstances. For example, for a watch or a household clock, an accuracy of ±1 minute may be acceptable. However, for a time clock, a radio station, or a national standard, the same accuracy is usually not acceptable. Furthermore, the required accuracy of a timekeeping device may be permitted to vary depending on current circumstances or conditions without causing a negative impact. For example, the required accuracy of a school clock on school days when students are present is greater than the required accuracy of the school clock on non-school days (e.g., weekends, vacations, etc.). In addition, synchronized clocks within a particular facility may not require the same accuracy. For example, a timekeeping device for ringing a school bell and operating school clocks with second hands may require synchronization within ±¼ second so that the clocks visually synchronize with bell ringing. In contrast, clocks without a second hand may be permitted to vary by ±5 seconds because visual synchronization is not apparent.

Previous methods have been developed to help improve free running accuracy of a timekeeping device. U.S. Pat. No. 4,448,543 discloses improving accuracy by compensating for changes in temperature; U.S. Pat. No. 4,899,117 discloses improving accuracy by compensating for crystal aging and temperature; and U.S. Pat. No. 5,274,545 discloses improving accuracy by accounting for systematic and random variations. However, all of these developments are limited to the timekeeping units themselves and require compensation hardware and/or software to be located within the units. In addition, the timekeeping units are intended for fixed, rather than variable, timekeeping accuracy requirements. For wireless synchronized systems including hundreds of remote wireless timekeeping devices, one central master unit, and variable timekeeping requirements, these methods would involve duplication of hardware for each remote device. These methods would also limit free running timekeeping accuracy and synchronization control to the hardware and/or software of each individual remote device. Furthermore, none of these methods disclose or suggest a system or method to increase battery life by adjusting individual timekeeping requirements to variable requirements that change based on, for example, time of day, a particular device's environment, or operating conditions of a particular device.

SUMMARY

Embodiments of the invention relate to a method and system of extending battery life of remote battery-operated timekeeping devices and apparatuses by minimizing the number of required synchronizations per unit of time needed to maintain a predetermined accuracy of the devices.

One embodiment of the invention is directed to a timekeeping device. The time keeping device includes a receiver configured to communicate with a master timekeeping device to synchronize the timekeeping device, a memory configured to store an accuracy value, and a processor. The processor is coupled to the receiver and the memory and is configured to maintain a local time. The processor is further configured to determine a timekeeping error between the local time and a master time of the master timekeeping device; calculate a compensation time; calculate a compensation amount based on the accuracy value and the timekeeping error; and calculate a synchronization time based on the accuracy value, the compensation amount, and the timekeeping error. The processor is also configured to, upon the compensation time elapsing, compensate the local time using the compensation amount to maintain the local time within the accuracy value; and, upon the synchronization time elapsing, synchronize the local time with the master time, wherein the synchronization time elapses after the compensation time elapses.

Another embodiment of the invention is directed to a timekeeping method for maintaining a local time within an accuracy value relative to a master timekeeping device. The timekeeping method includes the steps of determining a timekeeping error between the local time and a master time of the master timekeeping device; calculating a compensation time; calculating a compensation amount based on the accuracy value and the timekeeping error; and calculating a synchronization time based on the accuracy value, the compensation amount, and the timekeeping error. The method also includes, upon the compensation time elapsing, compensating the local time using the compensation amount to maintain the local time within the accuracy value. The method further includes, upon the synchronization time elapsing, synchronizing the local time with the master time, wherein the synchronization time elapses after the compensation time elapses.

Another embodiment of the invention is directed to a timekeeping system. The timekeeping system includes a master timekeeping device and a remote timekeeping device. The master timekeeping device includes a transmitter and is configured to keep a master time. The remote timekeeping device includes a processor configured to keep a local time within a range of the master time, wherein the range is plus or minus an accuracy value. The processor further includes a receiver coupled to the processor and configured to communicate with the master timekeeping device to synchronize the local time with the master time. The processor is configured to determine a timekeeping error between the local time and the master time; calculate a compensation time; calculate a compensation amount based on the accuracy value and the timekeeping error; and calculate a synchronization time based on the accuracy value, the compensation amount, and the timekeeping error. The processor is further configured to, upon the compensation time elapsing, compensate the local time using the compensation amount to maintain the local time within the accuracy value and to synchronize, after the compensation time elapses and the synchronization time elapses, the local time with the master time.

Another embodiment of the invention is directed to a method to reduce power consumption of a timekeeping device. The method includes setting a desired accuracy value of a timekeeping device, compensating for free running inaccuracies of the timekeeping device, and adjusting a period between synchronizations of the timekeeping device based on the compensated free running accuracy and the desired accuracy value to maximize battery life.

In some embodiments, the accuracy value may be a default value of the device, a set value, or a variable value. Additionally or alternatively, the accuracy value may be set at the timekeeping device or may be transmitted wirelessly to the device.

In further embodiments, compensation for the free running inaccuracies may be determined or calculated at a remote location. Additionally or alternatively, the free running inaccuracies may be based on an average inaccuracy value.

In still further embodiments, the method also includes receiving an input from an environmental sensor. In such embodiments, the input includes at least one of changes in ambient temperature, changes in oscillating crystal temperatures, and changes in light levels.

In other embodiments, the method further includes sensing an operational change of the timekeeping device. In such embodiments, the operational change includes at least one of a battery voltage and radio frequency interference.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting.

Figure 1:
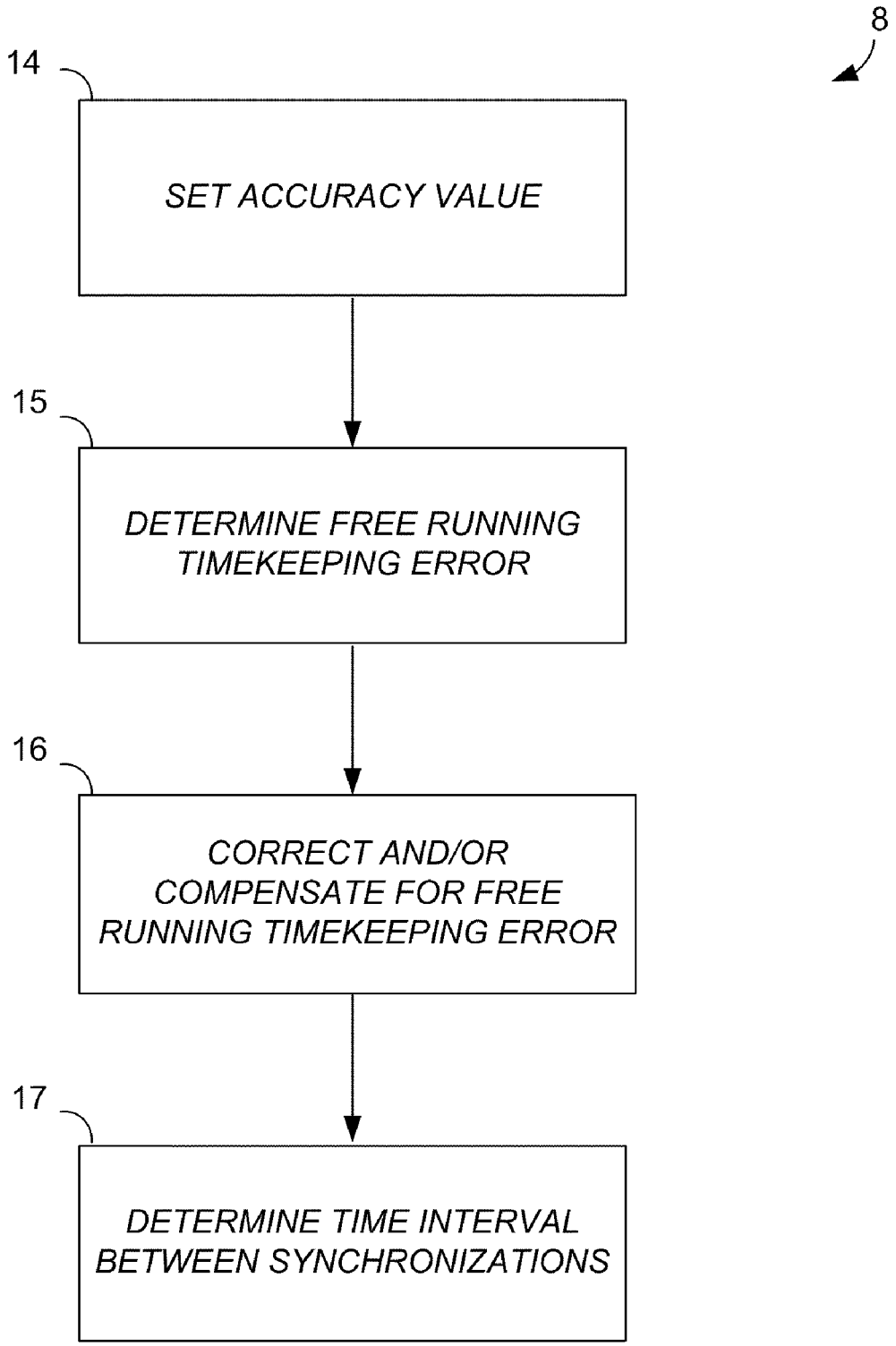
FIG. 1 is a flowchart depicting a method to maximize time intervals between synchronizations of a timekeeping device.
Figure 2:
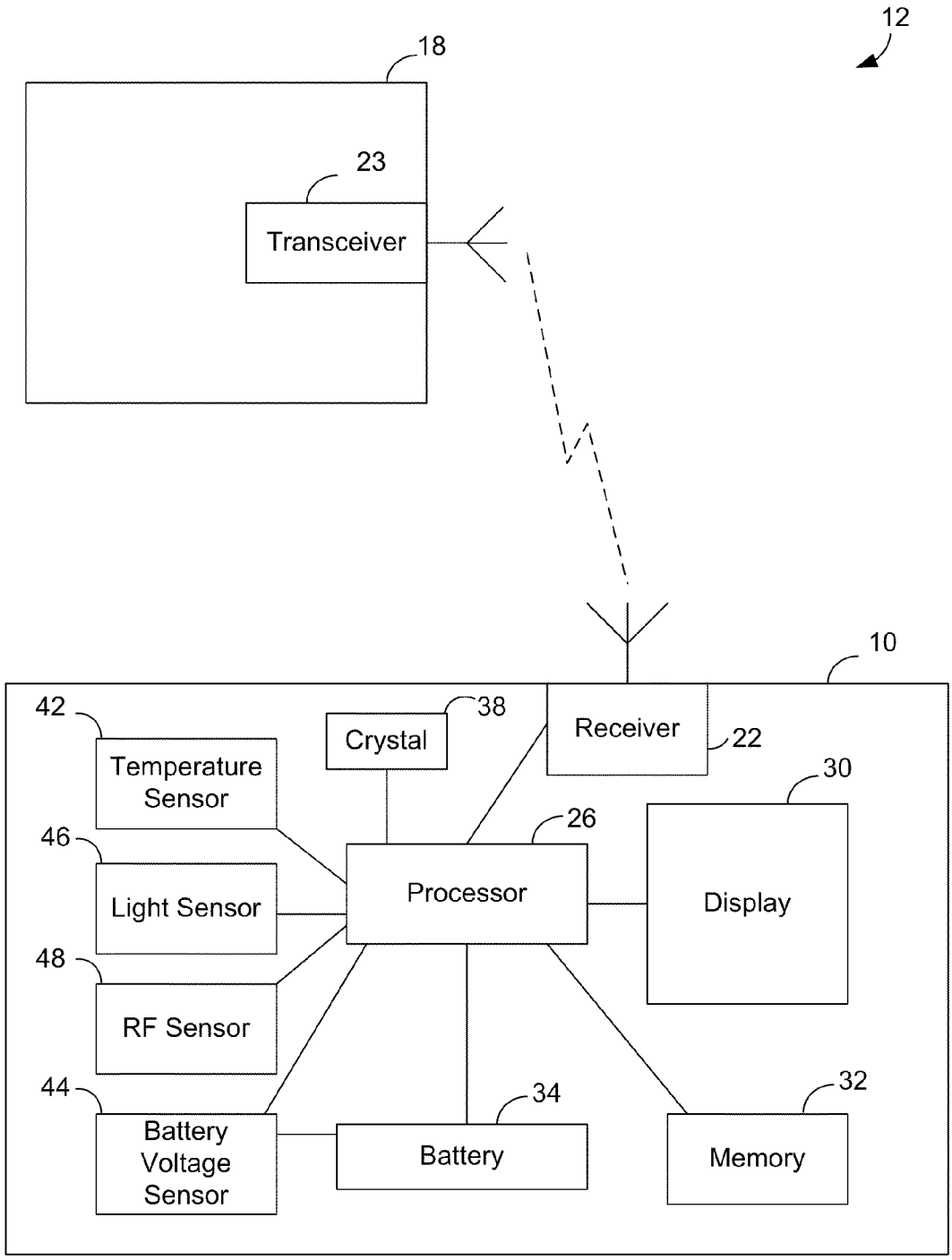
FIG. 2 schematically illustrates a wireless synchronous time system including a master timekeeping device and a remote battery-operated timekeeping device.

FIG. 1 depicts a method 8 to maximize time intervals between synchronizations of a remote battery-operated timekeeping device or apparatus 10 in a wireless synchronous time system 12 (FIG. 2). The method includes setting an accuracy value of the timekeeping device (step 14), determining a free running timekeeping error or inaccuracy of the timekeeping device (step 15), correcting and/or compensating for the free running error (step 16), and determining the time interval between synchronizations based at least in part on the free running error and the accuracy value (step 17). The method helps maximize battery life of the timekeeping device 10 by compensating for the device's free running error and by setting a synchronization time interval based on the free running error and the accuracy value of the timekeeping device 10. In some embodiments, accuracy values and computations for determining synchronization values of an individual timekeeping device can be carried out wholly or partly in the remote timekeeping device. In other embodiments, the accuracy values and computations can be carried out at an alternate location (e.g., a primary or master timekeeping device 18 (FIG. 2)) and then provided (e.g., wirelessly transmitted) to the remote timekeeping device.

As shown in FIG. 2, the timekeeping device 10 includes a receiver 22 to wirelessly receive time and/or non-time information from a transceiver 23 of the master device 18, a processor 26 to process the information, a display 30 to display the processed information, a memory 32 to store data, and a power source 34 (e.g., a battery) to power the other components of the timekeeping device 10. In some embodiments, the timekeeping device 10 may also include a transmitter to transmit information from the timekeeping device 10 to the master device 18. In the illustrated embodiment, the timekeeping device 10 includes all types of wireless system devices that receive and maintain time, such as, for example, clocks, watches, displays, message boards, speakers, alarms, lighting devices, programmable switches, timers, medical devices, phones, tools, appliances, space or military equipment, or the like.

The accuracy value of the timekeeping device 10 is the minimum timekeeping accuracy that the timekeeping device 10 will maintain or attempt to maintain. The accuracy value is combined with a free running and/or compensated accuracy of the timekeeping device 10 to determine, at least in part, the amount of time, or interval, until the next required synchronization of the timekeeping device 10. In some embodiments, the accuracy value is adjusted or set to meet variable requirements for a particular application in which the timekeeping device 10 is employed. In other embodiments, the accuracy value of the timekeeping device 10 may be locked or fixed to avoid tampering. In still other embodiments, the accuracy value may be a variable that changes with crystal drift, time, date, and/or environmental or operating conditions. Such a variable may be in the form of an equation, a look-up table, or stored historical data.

In some embodiments, the accuracy value of the timekeeping device 10 may be a built-in default value. In other embodiments, the accuracy value may be stored or set locally in the timekeeping device 10 (e.g., in the processor 26) or may be stored or set from a remote location (e.g., the master device 18). In such embodiments, remote settings and/or adjustments of accuracy values for remote timekeeping devices within a system may be made to individual devices, to some of the devices, or to all of the devices simultaneously.

The timekeeping device 10, and more particularly the processor 26 of the timekeeping device 10, includes means to correct or compensate for the timekeeping error. Timekeeping error correction and error compensation both improve timekeeping, but in different ways. For example, if the oscillator frequency of a time source causes a one second per day error in timekeeping, the error can be corrected by adjusting the frequency of the timekeeping oscillator to minimize the timekeeping error. This frequency adjustment is accomplished by, for example, changing the capacitance in the oscillating circuit with a variable capacitor or by adding or subtracting capacitors to or from the oscillating circuit.

In contrast to error correction, the error can be compensated for by leaving the frequency of the timekeeping oscillator unchanged and periodically adding and/or removing timekeeping pulses. This adjustment is made with, for example, firmware or software and can be done every fraction of a second, daily, or periodically when the accumulated error reaches a particular value or threshold. In some embodiments, both error correction and error compensation may be employed. Additionally or alternatively, other means for correcting or compensating for timekeeping error may also be employed.

After the timekeeping device 10 is powered, the timekeeping device 10 automatically turns on the receiver 22 and wirelessly receives a first synchronization time (ST1) from the master device 18, or source. The timekeeping device 10 synchronizes a free running internal time (FRT1) of the timekeeping device 10 to the first synchronization time (ST1). The time of the first synchronization is then recorded and stored. After a period of time, the timekeeping device 10 again turns on the receiver 22 and wirelessly receives a second synchronization time (ST2) from the same or a different master timekeeping source. A first free running internal time error (TE1) of the timekeeping device 10 is determined as a difference between the second synchronization time (ST2) and an internal free running time (FRT2) of the timekeeping device 10 at the time of reception of the second synchronization time. In addition to synchronizing the free running internal time (FRT2) of the timekeeping device 10 to the second synchronization time (ST2), the first time error (TE1) and the second synchronization time (ST2) are also recorded. The rate of the free running time error (RTE1) is then determined by dividing the first free running time error (TE1) by the time interval between the second synchronization time (ST2) and the first synchronization time (ST1).

The following simplified formulas can be used to carry out the calculations described above:

$$TE1=(FRT2-ST2)$$

where TE1 is the first free running time error, ST2 is the second synchronized time, and FRT2 is the free running time at the second synchronized time prior to synchronization, and $$RTE1=(TE1)/(ST2-ST1)$$

where RTE1 is the rate of the first free running timekeeping error, TE1 is the first timekeeping error, and ST1 is the first synchronized time.

Example 1

Single Compensation Between Synchronizations

The following example outlines a method of single compensation to increase the interval between synchronizations of a timekeeping device and, thereby, increase battery life.

Assume that the accuracy value was set at 200 milliseconds (ms) and the timekeeping device or apparatus has already received and recorded its first and second synchronizations with the following results:

Accuracy Value=200 ms
First Synchronization Time (ST1)=1:45 pm
Second Synchronization Time (ST2)=5:45 pm
Free Running Error at Time of Second Synchronization (TE1)=+100 ms
Interrupt Rate=10 ms (i.e., the uncertainty for each synchronization and error compensation)

Although the measured free running error is +100 ms, there is a 20 ms uncertainty (10 ms for the first synchronization and 10 ms for the second synchronization). The actual error is therefore between +80 ms and +120 ms. Thus, the Rate of First Free Running Timekeeping Error is:

$$RTE1=[(100\text{ ms}/4\text{ hrs})]=25\text{ ms/hr with an error range of }(+/-20\text{ ms})/4\text{ hr}=25\text{ ms/hr }(+/-5\text{ ms/hr})$$

$$\text{Max } RTE1=25\text{ ms/hr}+5\text{ ms/hr}=30\text{ ms/hr}$$

$$\text{Min } RTE1=25\text{ ms/hr}-5\text{ ms/hr}=20\text{ ms/hr}$$

where MaxRTE1 is the maximum rate of the first free running timekeeping error taking into consideration the interrupt rate and MinRTE1 is the minimum rate of the first free running timekeeping error taking into consideration the interrupt rate.

To determine the next required synchronization to prevent the free running time of the timekeeping device 10 from exceeding the accuracy constraints, the maximum actual error or error rate is assumed (i.e., +120 ms or 30 ms/hr). The next synchronization required is calculated by either of the following equations:

$$\text{Next synchronization without compensation}=ST2+[(\text{Accuracy Value/Max } RET1)]=5{:}45\text{ pm}+(200\text{ ms}/30\text{ ms/hr})=5{:}45\text{ pm}+6\text{ hr }40\text{ min}=12{:}25\text{ am}$$

Or $$\text{Next synchronization without compensation}=ST2+[(\text{Accuracy Value/Max actual error})\times(ST2-ST1)]=5{:}45\text{ pm}+[((200\text{ ms})/(120\text{ ms}))*(4\text{ hr})]=5{:}45\text{ pm}+6\text{ hr }40\text{ min}=12{:}25\text{ am}$$

With a single timekeeping compensation, the length of time until the next required synchronization can be increased by waiting until the aforementioned time (12:25 am) and, rather than synchronizing, compensating the timekeeping device 10 to extend the period between synchronizations. The time that will elapse before compensation (i.e., until the "next compensation time") is 6 hrs 40 min because, assuming a MaxRET1, the timekeeping device 10 will deviate +200 ms from the master device 18 after 6 hrs 40 min.

As shown above, the MaxRET1 is assumed in order to calculate when to compensate (or synchronize) the timekeeping device 10. The MinRET1, however, is used to determine the maximum compensation amount. Assuming a MinRET1 over 6 hrs 40 min, the uncompensated error would be approximately +130 ms (i.e., 6 hrs 40 min×20 ms/hr). Therefore, at 12:25 am, the uncompensated error would be between +130 ms (based on MinRET1) and +200 ms (based on MaxRET1). Note that the compensation interrupt at 12:25 am would add an additional 10 ms uncertainty to the compensated error calculations. Thus, an additional 10 ms is incorporated into the uncompensated error in anticipation of the interrupt error, and the minimum uncompensated error for purposes of calculating the compensation amount is +120 ms.

The particular compensation amount can be selected in a number of ways. For instance, the free running clock can be adjusted to aim for 1) the actual time using the minimum or maximum uncompensated error value (e.g., 120 ms or 200 ms) or some value therebetween; or 2) the far end of the accuracy value to maximize the time before the next synchronization by using the sum of the accuracy value and the minimum uncompensated error value (e.g., 200 ms+120 ms=320 ms). Thus, in one instance, compensating the timekeeping device 10 includes removing 120 ms. In another instance, compensating the timekeeping device 10 includes removing up to 320 ms. Adjusting the timekeeping device by removing 320 ms will maximize the time to the next synchronization without causing the device to exceed the minus end of the 200 ms accuracy value.

Using (i.e., subtracting) the 120 ms value would add 4 additional hours to the synchronization time without compensation, increasing the time between synchronizations from 6 hours and 40 minutes to 10 hours and 40 minutes, as shown in the following calculations:

Increase between synchronizations=compensation amount/MaxRTE1=(120 ms)/(120 ms/4 hrs)=4 hrs Synchronization period=(6 hrs 40 min)+(4 hrs)=10 hrs 40 min Using the 320 ms value would add 10 hours and 40 minutes to the synchronization time without compensation, increasing the time between synchronizations to 17 hours and 20 minutes, as shown in the following calculations:

Increase between synchronizations=compensation amount/MaxRTE1=(320 ms)/(120 ms/4 hrs)=10 hrs 40 min Synchronization period=(6 hrs 40 min)+(10 hrs 40 min)=17 hrs 20 min As shown below, even a single compensation for timekeeping error significantly increases the synchronization interval:

Typical synchronization period=4 hrs

Adjusting for device's accuracy=6 hrs 40 min

Single compensation (120 ms to 320 ms)=10 hrs 40 min to 17 hrs 20 min

Figure 3:
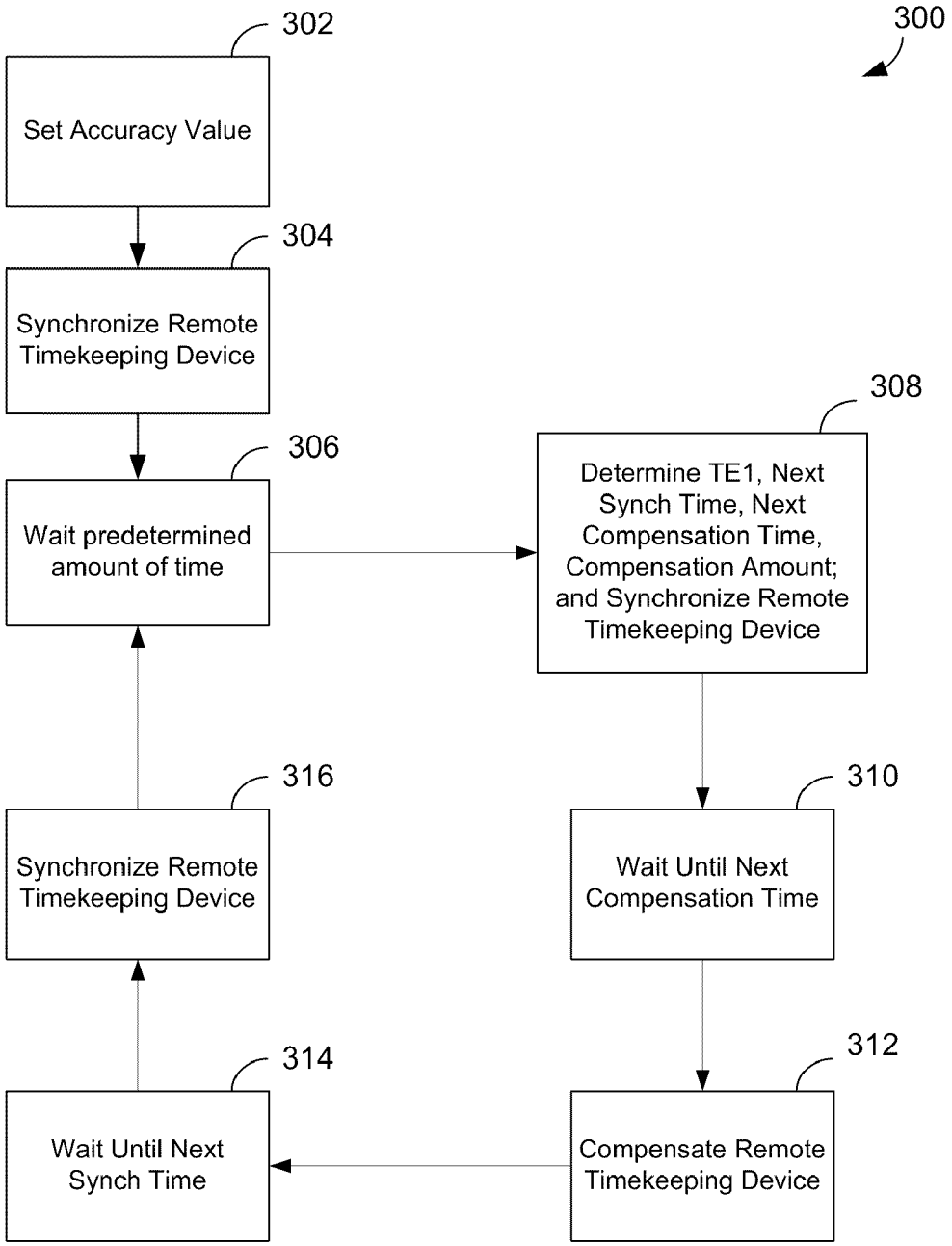
FIG. 3 is a flowchart depicting a method to increase time intervals between synchronizations of a timekeeping device using a single compensation.

FIG. 3 depicts a process 300 of compensating a timekeeping device in accordance with Example 1 as described above. In step 302, the accuracy value of the timekeeping device 10 is set, for instance, by storing a value in the memory 32 within the timekeeping device 10. In step 304, the timekeeping device 10 is synchronized with the master device 18. Thereafter, the timekeeping device 10 waits until a predetermined time elapses (e.g., 4 hours) in step 306. In step 308, the timekeeping device 10 calculates the free running time error (TE1), the next compensation time, the compensation amount, and the next synchronization time. Additionally, the timekeeping device 10 synchronizes with the master device 18. Thereafter, the timekeeping device 10 waits until the next compensation time (e.g., 12:25 am) in step 310. In step 312, the timekeeping device 10 compensates the free running clock using the compensation amount (e.g., by subtracting 320 ms). After compensation, the timekeeping device 10 waits until the next synchronization time in step 314. In step 316, the timekeeping device 10 again synchronizes with the master device 18. The timekeeping device 10 then repeats steps 306-316.

In some embodiments, the next synchronization time is calculated in step 312 instead of step 308. In some embodiments, the calculations are performed external to the timekeeping device 10, e.g., by the master device 18. In some embodiments, different master devices 18 are used for different synchronizations of the timekeeping device 10.

Additional compensations between synchronizations can be used to further lengthen the time between synchronizations. However, since each compensation adds uncertainty to the error and the uncertainty error of the timekeeping rate increases with time, the maximum time between compensations and the maximum time that is compensated is reduced with each compensation. The optimum number of compensations for maximum time between synchronizations will vary with the accuracy value, interrupt uncertainty, free running accuracy of the timekeeping device, and the minimum timekeeping compensation.

Example 2

Multiple Compensations Between Synchronizations

The following example outlines a method of multiple compensations to increase the interval between synchronizations of a timekeeping device and, thereby, increase battery life.

Using the assumptions from the previous example:

Accuracy Value=200 ms

First Synchronization Time=1:45 pm (+/−10 ms)

Second Synchronization Time=5:45 pm (+/−10 ms)

Free Running Error at Time of Second Synchronization=+100 ms (+/−20 ms)

Interrupt Rate=10 ms

The available timing window is ±200 ms (i.e., 400 ms) minus the 20 ms interrupt error, yielding a 380 ms available window. The free running error ranges from a maximum of 120 ms in 4 hours to a minimum of 80 ms in 4 hours. Dividing 380 ms by the 40 ms difference between the maximum and minimum free running errors and then multiplying by 4 hours yields the time at which the interrupt uncertainty exceeds the available accuracy window, as shown in the following calculation:

Time=[(400 ms−20 ms)/(120 ms−80 ms)]*(4 hrs)=38 hrs

Since each compensation introduces additional error, only a portion of the 38 hours can be achieved. The equations used to determine the time until compensation and amount of compensation are as follows:

Time until $1^{st}$ Compensation=((Accuracy Value−Interrupt Rate)/(*TE*1+2*Interrupt Rate))*(*ST*1−*ST*2)=(Accuracy Value−Interrupt Rate)/Max *RET*1

Amount of $1^{st}$ Compensation=−Accuracy Value+Interrupt Rate−(MinRTE1*Time to 1st Compensation)+Interrupt Rate Time until $N^{th}$ Compensation=(Amount of $(N-1)^{th}$ Compensation/(*TE*1+2*Interrupt Rate))*(*ST*1−*ST*2)=(Amount of $N-1^{th}$ Compensation)/Max *RET*1

Figure 5:
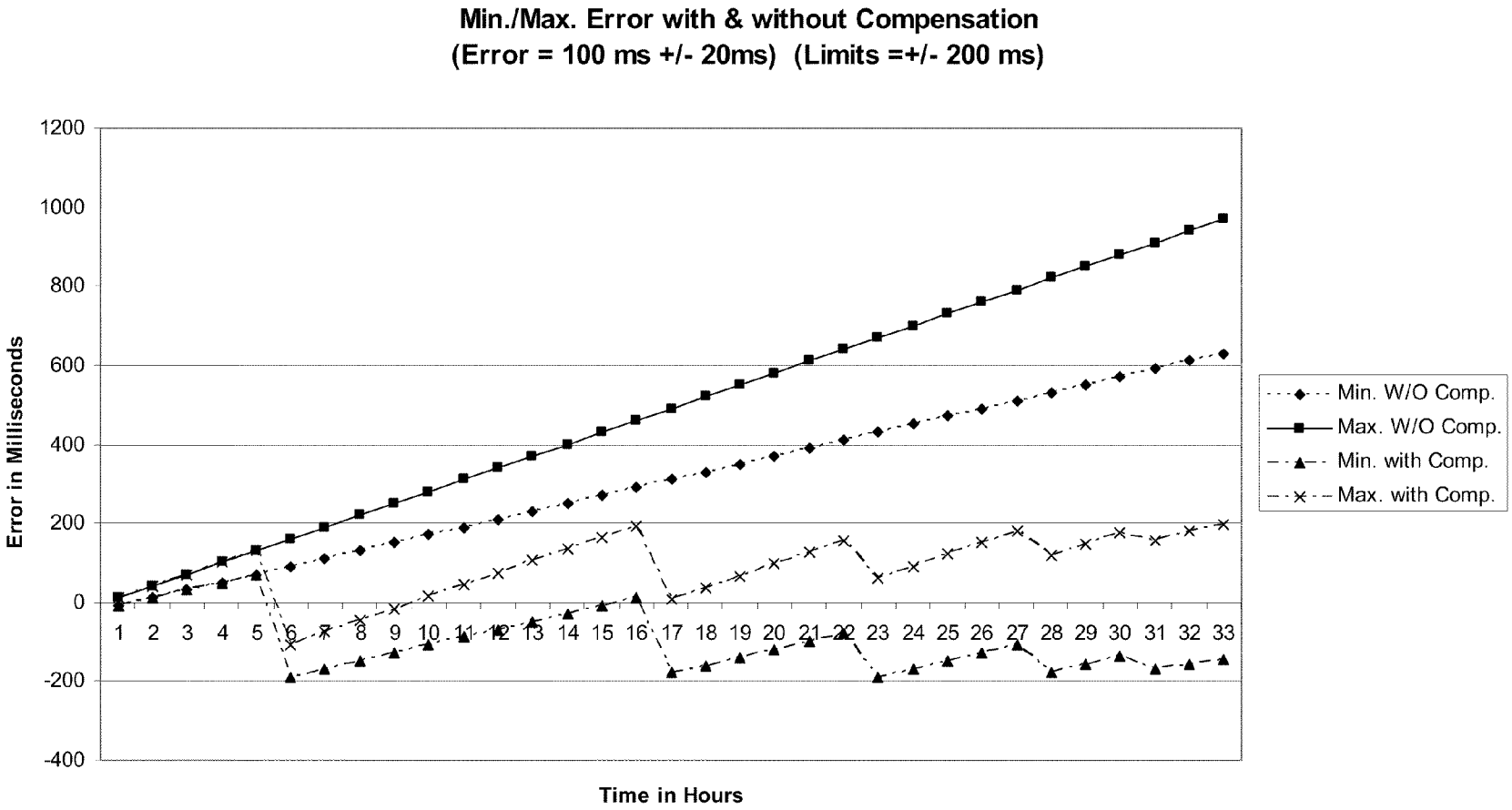
FIG. 5 is a graph illustrating the minimum and maximum error in milliseconds over time of the remote battery-operated timekeeping device with and without compensation.
Figure 5A:
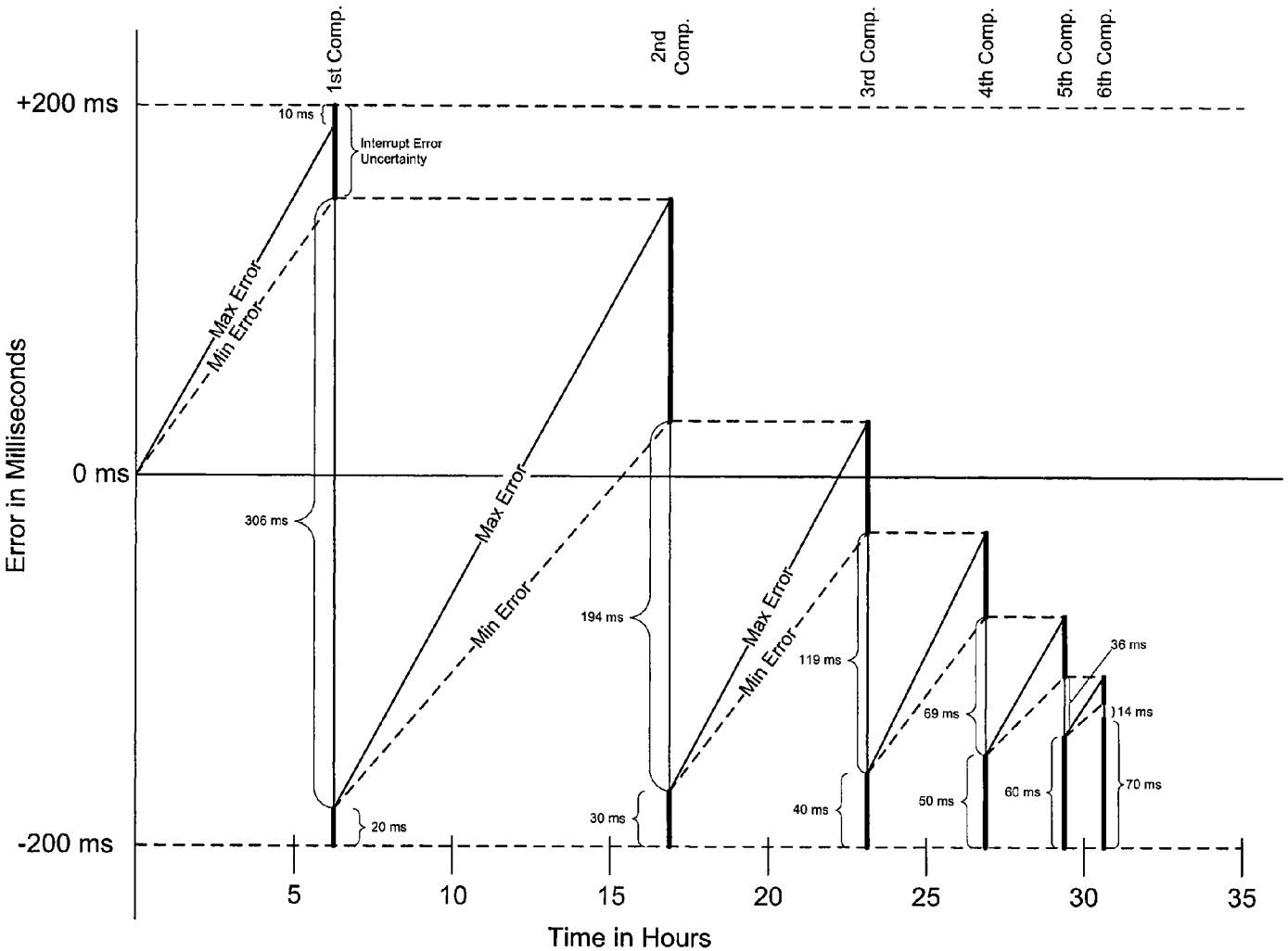
FIG. 5*a* is a graph illustrating the error in milliseconds over time of the remote battery-operated timekeeping device and compensations being made.

Amount of $N^{th}$ Compensation=(−Min*RTE*1*Time to $(N-1)^{th}$ Compensation)+Interrupt Rate The accuracy of the time at the start of this new synchronization period is +10 ms and the rate of error is 100 ms ±20 ms every 4 hours. With this information, the compensations should occur as follows:

Time until $1^{st}$ Compensation=((200 ms−10 ms)/(100 ms+20 ms))*4 hrs=6 hrs 20 min Amount of $1^{st}$ Compensation=[−200 ms+10 ms−(80 ms/4 hrs)*(6.3 hrs)]+10 ms=−306 ms Time until $2^{nd}$ Compensation=(306 ms/120 ms)*4 hrs=10 hrs 12 min Amount of $3^{rd}$ Compensation=[(−80 ms/4 hrs)*(10.2 hrs)]+10 ms=−194 ms Time until $3^{rd}$ Compensation=(194 ms/120 ms)*(4 hrs)=6 hrs 28 min Amount of $3^{rd}$ Compensation=(−80 ms/4 hrs)*(6.46 hrs)+10 ms=−119 ms Time until $4^{th}$ Compensation=(139 ms/120 ms)*(4 hrs)=3 hrs 58 min Amount of $4^{th}$ Compensation=(−80 ms/4 hrs)*(4.63 hrs)+10 ms=69 ms Time until $5^{th}$ Compensation=(82 ms/120 ms)*(4 hrs)=2 hrs 18 min Amount of $5^{th}$ Compensation=(−80 ms/4 hrs)*(2.73 hrs)+10 ms=36 ms Time until $6^{th}$ Compensation=(44 ms/120 ms)*(4 hrs)=1 hr 12 min Amount of $6^{th}$ Compensation=(−80 ms/4 hrs)*(1.47 hrs)+10 ms=14 ms Time between synchronizations with six compensations=30 hrs 28 min FIG. 5 is a graph illustrating the minimum and maximum error in ms over time of a device with and without compensation. FIG. 5*a* is a graph illustrating the error in milliseconds over time of the remote battery-operated timekeeping device and compensations being made.

Remote timekeeping devices or apparatuses have interrupt rates which limit accuracy of synchronizations and compensations. Different timekeeping device systems have different interrupt rates with interrupts ranging from, for example, 1 to 40 ms. As a result, error compensation includes some level of uncertainty, which should be considered when making error calculations, adjustments, and calculations for the next resynchronization period of time. The accuracy value divided by twice the interrupt rate will give the maximum number of error compensations permitted before resynchronization. For example, if the accuracy value is 0.1 second per day and the interrupt rate is 10 ms, then the maximum number of error compensations between resynchronizations would be 5. Similarly, if the accuracy value were increased to 1.0 seconds per day, the maximum number of error compensations between resynchronizations would be 50. Reducing the number of synchronizations per synchronization period by 9 extends the battery life of a remote device by between about 2 to 20 days per synchronization, depending on the timekeeping device. Appropriately setting or adjusting the accuracy value to fit the accuracy requirements of a particular timekeeping device has a significant impact on battery life.

The rate of free running time error calculation can be repeated for each resynchronization and can be compared, averaged, and/or analyzed for trends and patterns to form a more accurate description of the actual timekeeping rate of error over time. Furthermore, when multiple compensations are used within a synchronization time period, interrupt errors can be minimized with statistical compensation for those errors.

Figure 4:
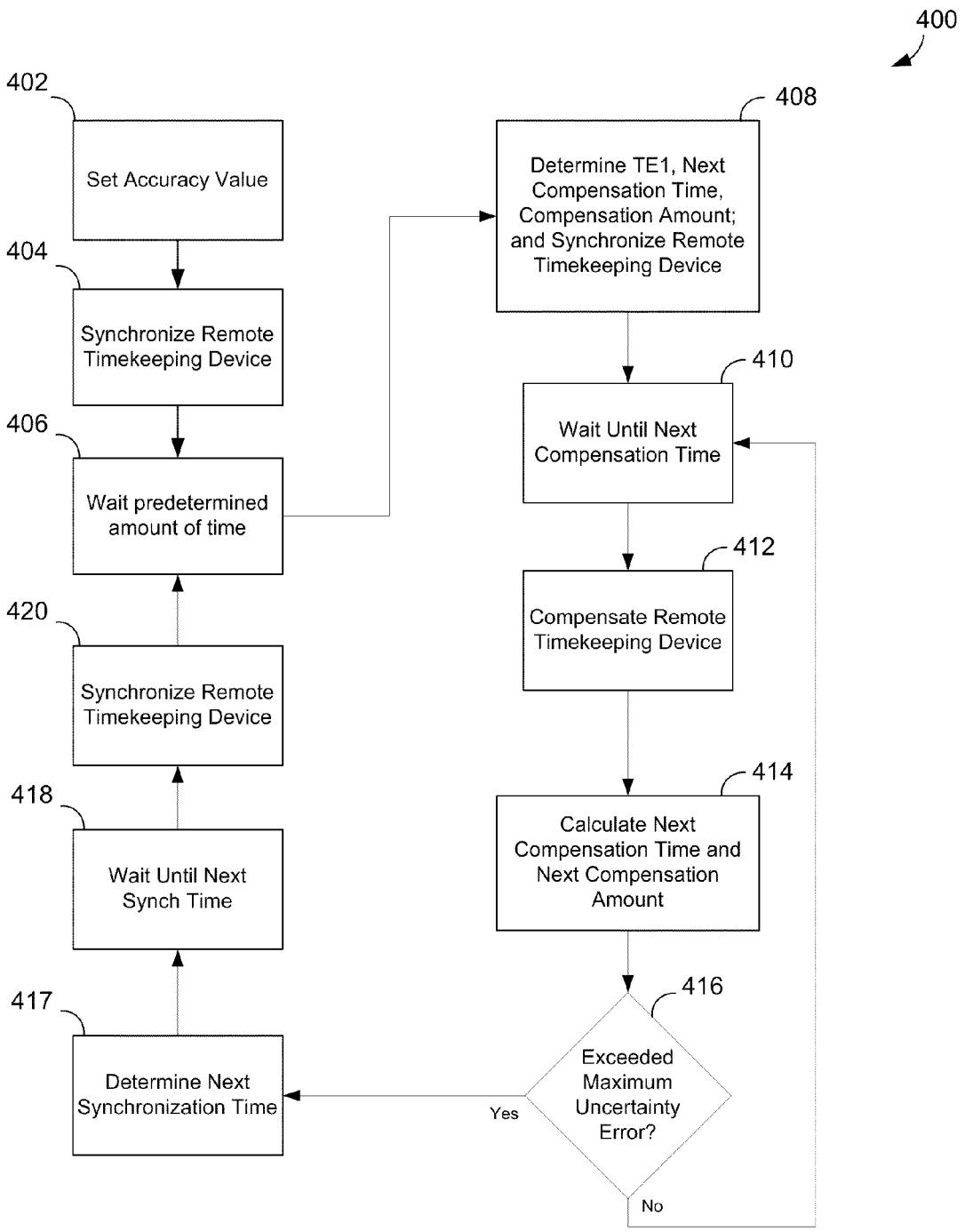
FIG. 4 is a flowchart depicting a method to increase time intervals between synchronizations of a timekeeping device using multiple compensations.

FIG. 4 depicts a process 400 of compensating a timekeeping device in accordance with Example 2 as described above. In step 402, the accuracy value of the timekeeping device 10 is set, for instance, by storing a value in a memory (not shown) within the timekeeping device 10. In step 404, the timekeeping device 10 is synchronized with the master device 18. Thereafter, the timekeeping device 10 waits until a predetermined time elapses (e.g., 4 hours) in step 406. In step 408, the timekeeping device 10 calculates the free running time error (TE1), the next compensation time, and the compensation amount. Additionally, the timekeeping device 10 synchronizes with the master device 18. Thereafter, the timekeeping device 10 waits until the next compensation time in step 410.

In step 412, the timekeeping device 10 compensates the free running clock using the compensation amount. After compensation, the timekeeping device 10 calculates the next compensation time and the next compensation amount in step 414. The next compensation amount is used to compensate the timekeeping device 10 when the next compensation time is reached. In step 416, the timekeeping device 10 determines if the maximum uncertainty error will be exceeded by another compensation. If not, the timekeeping device 10 proceeds back to step 410 to wait until the next compensation time is reached. The timekeeping device 10 repeats steps 410-16 making additional compensations until, in step 410, the timekeeping device 10 determines that the maximum uncertainty error has been exceeded. In step 417, the next synchronization time is calculated (i.e., the point at which the timekeeping device 10 can no longer be guaranteed to be within the accuracy value). In step 418, the timekeeping device 10 waits until the next synchronization time. In step 420, the timekeeping device 10 again synchronizes with the master device 18. The timekeeping device 10 then proceeds back to step 406.

In some embodiments, the next synchronization time is calculated earlier than step 417. In some embodiments, the calculations are performed external to the timekeeping device 10, e.g., by the master device 18. In some embodiments, multiple or all of the compensation times, compensation amounts, and the next synchronization time are calculated at once (e.g., in step 408). In some embodiments, different master devices 18 are used for different synchronizations of the timekeeping device 10.

Figure 6:
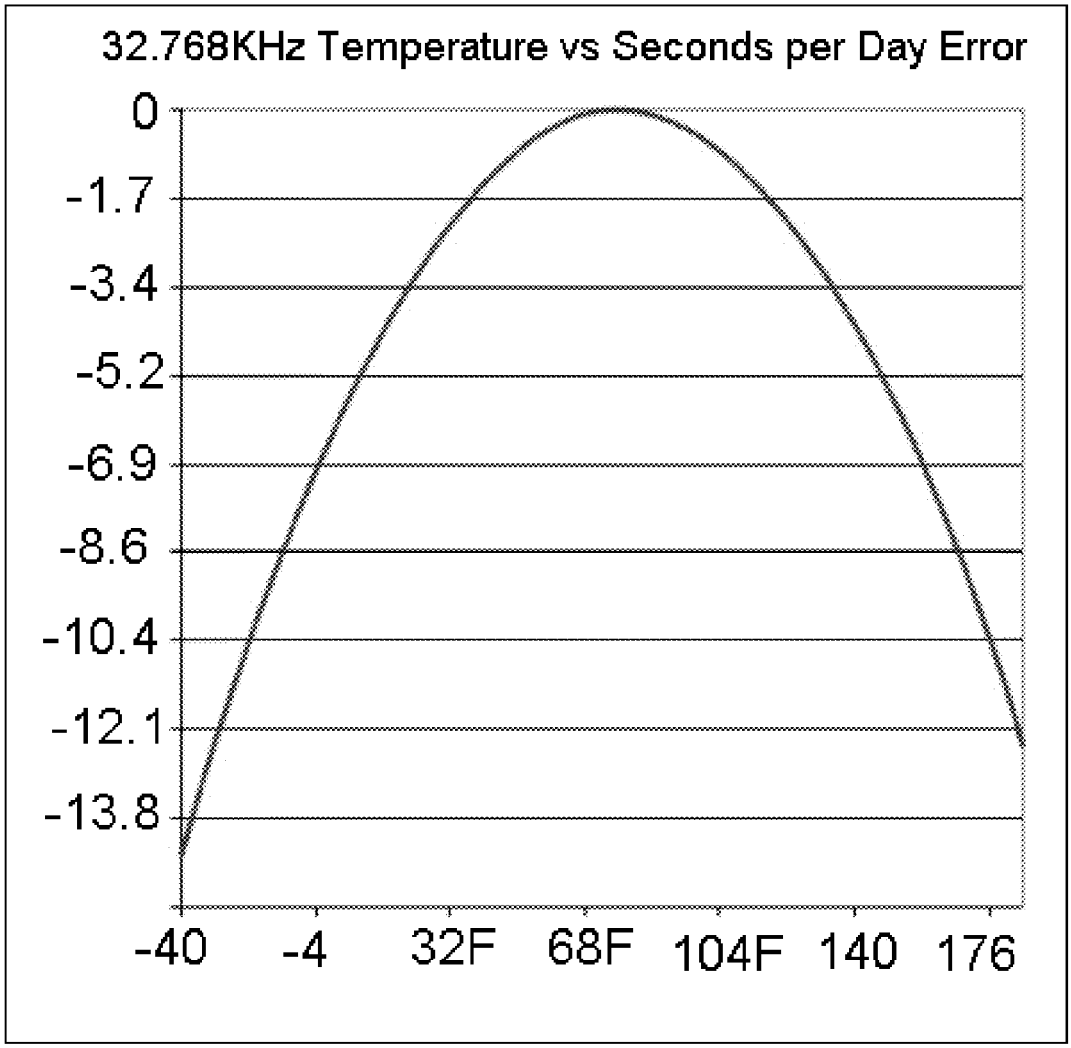
FIG. 6 is a graph illustrating the changes in accuracy of a 32.768 kHz oscillating crystal at different temperatures.

Referring back to FIG. 2, the illustrated timekeeping device 10 includes an oscillating crystal 38 (e.g., a 32.768 kHz oscillating crystal). The timekeeping device 10, and more particularly the crystal 38, is temperature-sensitive. If the timekeeping device 10 is located in a building or outside where the temperature falls at night, the timekeeping device 10 will have a different timekeeping accuracy at night than during the day. By analyzing the error calculations over time, the error that will occur during various time intervals can be anticipated and adjusted for during the appropriate period, rather than in response to an error that has already occurred. FIG. 6 is a graph illustrating the changes in accuracy of a 32.768 kHz crystal at different temperatures.

The illustrated timekeeping device 10 also includes a temperature sensor 42 to detect the current temperature of the crystal 38. Sensors that detect environmental changes, and especially those that are not controlled or powered, significantly improve forecasting timekeeping accuracy by compensating for the accuracy changes rather than trying to compensate for the changes after the changes occur.

In embodiments in which the timekeeping device 10 is hung where the crystal 38 can experience wide temperature changes (e.g., outdoors, in an entryway, facing an outdoor window, near a heat register, or the like), an additional environmental temperature sensor can be used to measure and compensate for the temperature fluctuations as they occur. Such compensations do not preclude the previously mentioned error compensation, but are in addition to the timekeeping error compensation method discussed above.

In one embodiment, the timekeeping device 10 monitors the ambient temperature or the crystal 38 temperature, using the temperature sensor 42, between a synchronization and a compensation (e.g., in step 310 of FIG. 3). In step 312, the compensation amount is modified before being used to compensate the timekeeping device 10 based on changes in the temperature during step 310. For instance, the compensation amount is altered if the temperature has changed since the original calculation in step 308. In another embodiment, the timekeeping device 10 monitors the ambient temperature or crystal 38 temperature using the temperature sensor 42 between a synchronization and a compensation and/or between two compensations (e.g., in step 410 of FIG. 4). In step 412, the compensation amount is modified before being used to compensate the timekeeping device 10 based on changes in the temperature during step 410.

In other embodiments, rather than a thermal sensor being used to compensate for environmental changes, the sensor can alert the device to an environmental change and instruct the device to verify the timekeeping accuracy. For instance, the temperature sensor 42 causes the timekeeping device 10 to synchronize with the master device 18 if a particularly large change in temperature occurs during a wait state of process 300 or 400 (e.g., during steps 310, 314, 410, 418). Additionally, if a particularly large change in temperature occurs during step 306 or 406, the timekeeping device 10 may restart the process 300 or 400, respectively, as the compensation amount calculated could vary significantly.

In some embodiments, additional accuracy checks or synchronizations may be periodically or randomly scheduled based on a priority of accuracy or on battery life to assure the accuracy at some reduced battery life. In other embodiments, sensing operational conditions, such as battery voltage (e.g., with battery voltage sensor 44) may be used to modify synchronization times to extend battery life at the expense of accuracy.

Sensing other operational or environmental changes, such as lighting levels or radio frequency (RF) interference, can also be beneficial. The lighting level is sensed using, for instance, light sensor 46. Although lighting levels will not normally affect accuracy, these levels can affect the required accuracy or operating conditions and battery life of the timekeeping device 10. For example, if an area is too dark to see, then there is no need to run a second hand of the timekeeping device 10. If an area is sufficiently bright, then backlighting for an LED display can be turned off Furthermore, if a room is dark and unoccupied, the timekeeping device 10 can delay synchronizations while those conditions persist. The RF interference is sensed using, for instance, an RF sensor 48. Sensing RF interference can be used to adjust the synchronization times to occur when less interference is present.

Although the invention has been described in detail with reference to wireless battery-operated timekeeping devices, variations and modifications exist within the scope and spirit of one or more independent aspects of the invention as described. For example, in other embodiments, the synchronous time system 12 may be non-wireless (e.g., a wired synchronous time system, or the like) and/or the timekeeping device 10 may be non-battery powered (e.g., AC powered, powered by an alternator, or the like). In such embodiments, reducing the number of synchronizations helps reduce the number of communications between the master device 18 and the timekeeping device 10, limiting the number of signal transmissions between the devices 10, 18 and reducing the overall power consumption of the synchronous time system 12.

The method 8, method 300, and method 400 include computations, synchronizations, determinations, and other steps, which are carried out electronically by software being executed and/or hardware. For instance, the steps may be carried out by software or firmware executed on a computer, microcontroller, microprocessor, application-specific integrated circuit (ASIC), field programmable gate array (FPGA), or other hardware (e.g., within the master device 18 or timekeeping device 10). In some embodiments, the software or firmware is stored on a computer readable medium, e.g., a computer hard drive, compact-disc, floppy disc, flash drive, or other memory device. In some embodiments, a portion or all of the method steps are carried out by hardware such as an ASIC, an FPGA, or the like.

Thus, the invention provides, among other things, methods and systems of extending battery life of remote battery-operated timekeeping devices by minimizing the number of required synchronizations per unit of time needed to maintain a predetermined accuracy of the devices. Various features and advantages of the invention are set forth in the following claims.

What is claimed is:

1. A timekeeping device comprising:

a receiver configured to communicate with a master timekeeping device to synchronize the timekeeping device;

a memory configured to store an accuracy value;

a processor coupled to the receiver and the memory and configured to maintain a local time, wherein the processor is further configured to, determine a timekeeping error between the local time and a master time of the master timekeeping device;

calculate a compensation time;

calculate a compensation amount based on the accuracy value and the timekeeping error;

calculate a synchronization time based on the accuracy value, the compensation amount, and the timekeeping error;

upon the compensation time elapsing, compensate the local time using the compensation amount to maintain the local time within the accuracy value; and upon the synchronization time elapsing, synchronize the local time with the master time, wherein the synchronization time elapses after the compensation time elapses.

2. The timekeeping device of claim 1, wherein the timekeeping error is determined based on a difference between the local time and the master time between a first synchronization and a second synchronization.

3. The timekeeping device of claim 1, wherein the compensation time is calculated based on the accuracy value and a rate at which the local time deviates from the master time.

4. The timekeeping device of claim 1, wherein the compensation amount includes a sum of the accuracy value and the timekeeping error.

5. The timekeeping device of claim 1, wherein the processor is further configured to:

calculate a second compensation time;

calculate a second compensation amount; and upon the second compensation time elapsing, compensate the local time using the second compensation amount to maintain the local time within the accuracy value, wherein the synchronization time elapses after the second compensation time elapses.

6. The timekeeping device of claim 1, wherein the timekeeping device is configured to delay a synchronization with the master time by compensating the local time and, thereby maintain the local time within the accuracy value.

7. The timekeeping device of claim 1, further including an environmental sensor configured to output changes in one of ambient temperature, oscillating crystal temperatures, and light levels.

8. The timekeeping device of claim 1, further including at least one of an operational sensor configured to output one of a battery voltage level and a radio frequency interference level.

9. The timekeeping device of claim 1, wherein the processor is further configured to:

iteratively calculate additional compensation times;

calculate an additional compensation amount for each of the additional compensation times; and compensate the local time using the associated additional compensation amount to maintain the local time within the accuracy value upon each of the additional compensation times elapsing, until a further compensation would not ensure that the local time remains within the accuracy value.

10. A timekeeping method for maintaining a local time within an accuracy value relative to a master timekeeping device, the method comprising:

determining a timekeeping error between the local time and a master time of the master timekeeping device;

calculating a compensation time;

calculating a compensation amount based on the accuracy value and the timekeeping error;

calculating a synchronization time based on the accuracy value, the compensation amount, and the timekeeping error;

upon the compensation time elapsing, compensating the local time using the compensation amount to maintain the local time within the accuracy value; and upon the synchronization time elapsing, synchronizing the local time with the master time, wherein the synchronization time elapses after the compensation time elapses.

11. The timekeeping method of claim 10, wherein the timekeeping error is determined based on a difference between the local time and the master time between a first synchronization and a second synchronization.

12. The timekeeping method of claim 10, wherein the compensation time is calculated based on the accuracy value and a rate at which the local time deviates from the master time.

13. The timekeeping method of claim 10, wherein the compensation amount includes a sum of the accuracy value and the timekeeping error.

14. The timekeeping method of claim 10 further including:

calculating a second compensation time;

calculating a second compensation amount; and upon the second compensation time elapsing, compensating the local time using the second compensation amount to maintain the local time within the accuracy value, wherein the synchronization time elapses after the second compensation time elapses.

15. The timekeeping method of claim 10 further including delaying a synchronization with the master time by compensating the local time and, thereby, maintaining the local time within the accuracy value.

16. The timekeeping method of claim 10, further including outputting one of an ambient temperature, an oscillating crystal temperature, a light levels, a battery voltage level, and a radio frequency interference level.

17. The timekeeping method of claim 10 further including:

calculating additional compensation times;

calculating an additional compensation amount for each of the additional compensation times; and upon each of the additional compensation times elapsing, compensating the local time using the associated additional compensation amount to maintain the local time within the accuracy value, wherein the synchronization time elapses after the additional compensation times elapse.

18. A timekeeping system comprising:

a master timekeeping device including a transmitter, wherein the master timekeeping device is configured to keep a master time;

a remote timekeeping device including, a processor configured to keep a local time within a range of the master time, wherein the range is plus or minus an accuracy value; and a receiver coupled to the processor and configured to communicate with the master timekeeping device to synchronize the local time with the master time;

wherein at least one of the processor, the master timekeeping device, and a combination thereof, is configured to determine a timekeeping error between the local time and the master time;

calculate a compensation time;

calculate a compensation amount based on the accuracy value and the timekeeping error; and calculate a synchronization time based on the accuracy value, the compensation amount, and the timekeeping error;

wherein the processor is configured to upon the compensation time elapsing, compensate the local time using the compensation amount to maintain the local time within the accuracy value; and synchronize, after the compensation time elapses and the synchronization time elapses, the local time with the master time.

19. The timekeeping system of claim 18, wherein the timekeeping error is determined based on a difference between the local time and the master time between a first synchronization and second synchronization.

20. The timekeeping system of claim 18, wherein the compensation time is calculated based on the accuracy value and a rate at which the local time deviates from the master time.

21. The timekeeping system of claim 18, wherein the compensation amount includes a sum of the accuracy value and the timekeeping error.

22. The timekeeping system of claim 18, wherein at least one of the processor, the master timekeeping device, and a combination thereof, is further configured to calculate a second compensation time and a second compensation amount;

wherein the processor is further configured to compensate the local time using the second compensation amount to maintain the local time within the accuracy value upon the second compensation time elapsing; and wherein the synchronization time elapses after the second compensation time elapses.

23. The timekeeping system of claim 18, wherein at least one of the processor, the master timekeeping device, and a combination thereof is configured to delay a synchronization with the master time by compensating the local time and, thereby, maintain the local time within the accuracy value.

24. The timekeeping system of claim 18, wherein at least one of the processor, the master timekeeping device, and a combination thereof, is further configured to calculate additional compensation times and an additional compensation amount for each of the additional compensation times;

wherein, upon each additional compensation time elapsing, the processor is further configured to compensate the local time using the associated additional compensation amount to maintain the local time within the accuracy value; and wherein the synchronization time elapses after the additional compensation times elapse.

* * * * *